US009297390B2

(12) United States Patent
Bröker et al.

(10) Patent No.: US 9,297,390 B2
(45) Date of Patent: Mar. 29, 2016

(54) EXHAUST GAS DIFFUSER FOR A GAS TURBINE AND A METHOD FOR OPERATING A GAS TURBINE THAT COMPRISES SUCH AN EXHAUST GAS DIFFUSER

(75) Inventors: Marc Bröker, Dinslaken (DE); Tobias Buchal, Düsseldorf (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 446 days.

(21) Appl. No.: 13/810,310

(22) PCT Filed: Jul. 13, 2011

(86) PCT No.: PCT/EP2011/061944

§ 371 (c)(1),
(2), (4) Date: Jan. 15, 2013

(87) PCT Pub. No.: WO2012/007499

PCT Pub. Date: Jan. 19, 2012

(65) Prior Publication Data

US 2013/0115044 A1 May 9, 2013

(30) Foreign Application Priority Data

Jul. 15, 2010 (EP) ..... 10007333

(51) Int. Cl.

| | |
|---|---|
| ***F04D 29/54*** | (2006.01) |
| ***F01D 9/02*** | (2006.01) |
| ***F01D 17/14*** | (2006.01) |
| ***F01D 25/30*** | (2006.01) |

(52) U.S. Cl.

CPC *F04D 29/54* (2013.01); *F01D 9/02* (2013.01); *F01D 17/141* (2013.01); *F01D 25/30* (2013.01); *F05D 2250/324* (2013.01); *F05D 2250/711* (2013.01)

(58) Field of Classification Search

CPC ..... F04D 29/54; F01D 17/141; F01D 17/14; F01D 9/02; F01D 25/303; F01D 25/30; F05D 2250/324; F05D 2250/711

See application file for complete search history.

(56) References Cited

U.S. PATENT DOCUMENTS

| | | | | |
|---|---|---|---|---|
| 2,703,959 | A * | 3/1955 | Wetherbee, Jr. | 239/265.33 |
| 3,678,690 | A * | 7/1972 | Shohet et al. | 60/226.3 |
| 5,209,634 | A | 5/1993 | Owczarek | |

FOREIGN PATENT DOCUMENTS

| | | |
|---|---|---|
| DE | 19805115 A1 | 8/1999 |
| EP | 1970539 | 9/2008 |

(Continued)

*Primary Examiner* — Richard Edgar

(57) ABSTRACT

An exhaust gas diffuser for a gas turbine is provided. The diffuser has an annular outer wall for guiding the diffuser flow and in which an annular guiding element is arranged concentrically to the outer wall and influences the diffuser flow. The guiding element has a surface which is radially directed inwards and has a circumferential contour that is convex in the longitudinal section to form a displacement element. The guiding element is axially displaceable between two positions so that the guiding element, when in a first position, allows a flow between the guiding element and outer wall and, when in a second position, largely prohibits a flow between the guiding element and outer wall. The aerodynamic effect of the diffuser is improved and simultaneously optimal adapted for a plurality of operational gas turbine states.

8 Claims, 2 Drawing Sheets

(56) References Cited

FOREIGN PATENT DOCUMENTS

| | | | |
|---|---|---|---|
| EP | 1970539 | A1 | 9/2008 |
| FR | 1576003 | A | 7/1969 |
| JP | 55500997 | | 12/1980 |
| JP | S63100640 | A | 5/1988 |
| JP | 2006322462 | A | 11/2006 |
| JP | 2009103099 | A | 5/2009 |
| SU | 357354 | A1 | 10/1972 |
| WO | WO 8000989 | A1 | 5/1980 |

* cited by examiner

EXHAUST GAS DIFFUSER FOR A GAS TURBINE AND A METHOD FOR OPERATING A GAS TURBINE THAT COMPRISES SUCH AN EXHAUST GAS DIFFUSER

CROSS REFERENCE TO RELATED APPLICATIONS

This application is the U.S. National Stage of International Application No. PCT/EP2011/061944 filed Jul. 13, 2011 and claims the benefit thereof. The International Application claims the benefits of European application No. 10007333.7 filed Jul. 15, 2010, both of the applications are incorporated by reference herein in their entirety.

FIELD OF THE INVENTION

The invention relates to an exhaust gas diffuser for a gas turbine, having an annular outer wall for guiding the diffuser flow, in which an annular guiding element, which is arranged concentrically to the outer wall, is provided for influencing the diffuser flow. In addition, the invention relates to a method for operating a gas turbine having an exhaust gas diffuser of the aforesaid type.

BACKGROUND OF THE INVENTION

Gas turbines and the exhaust gas diffusers used for these have been known at the latest from the prior art. For example, an exhaust gas diffuser with a comparatively large opening angle of 10° and more is known from DE 198 05 115 A1. This rather large opening angle is achieved by provision being made in the center of the diffuser passage for an axially extending guiding body for extending an otherwise short gas turbine hub. By using the guiding body, the exhaust gas diffuser is formed as an annular diffuser. Larger regions of backflow zones aft of the gas turbine hub are consequently avoided, which has an advantageous effect upon the efficiency of the exhaust gas diffuser. The fact that the guiding body is comparatively long and on account of its length therefore has to be supported by means of additional struts is disadvantageous, however. Furthermore, the aerodynamic influences of the support struts are disregarded.

The known short gas turbine hubs mostly terminate directly aft of the turbine-side bearings of the gas turbine rotor. They have particularly large backflow zones, however. Nevertheless, the short gas turbine hubs are also particularly cost effective.

Also, an exhaust gas diffuser, which on the inside has an annular guiding element which is concentric to the outer wall, is known from EP 1 970 539 A1. The guiding element is designed in this case in such a way that a nozzle passage is formed between outer wall and guiding element, with the aid of which nozzle passage the near-wall flow can be accelerated. As a result, it is possible to avoid near-wall flow separations downstream of the guiding element. Influencing of the flow in the center of the exhaust gas diffuser, where backflows can occur, is not possible, however, with the aid of the guiding element.

Furthermore, U.S. Pat. No. 5,209,634 A1 discloses a steam-turbine diagonal diffuser with variable hub geometry for adjusting the diffuser cross section through which flow can pass.

The aim also exists of avoiding as far as possible the backflow zones located aft of the gas turbine hub, or of minimizing their extent, so that even during partial-load operation of the gas turbine high efficiency of the exhaust gas diffuser can be achieved and high operational reliability can be ensured. In the case of backflow zones reaching too far downstream, there is the risk that these can reach a boiler arranged downstream of the exhaust gas diffuser, which significantly degrades its principle of operation. Also, in the case of afterburners which are installed there, these would lead to a flashback, as a result of which the combined operation of gas turbines and afterburners is severely limited.

SUMMARY OF THE INVENTION

The invention is based on the object of disclosing a space-saving exhaust gas diffuser for a gas turbine, which, while achieving a highest possible level of efficiency of the gas turbine, avoids flow separations and backflow zones for each operating state of the gas turbine and ensures a reliable operation of boilers and afterburners, which are arranged downstream of the gas turbine, for each operating state of the gas turbine. It is a further object of the invention to additionally disclose a method for operating a gas turbine having an exhaust gas diffuser.

The object which is directed towards an exhaust gas diffuser and a method is achieved according to the features of the claims.

The exhaust gas diffuser according to the invention for a gas turbine has an annular outer wall for guiding the diffuser flow, in which an annular guiding element, which is arranged concentrically to the outer wall, is provided for influencing the diffuser flow, wherein a radially inwardly oriented surface of the guiding element has an encompassing contour, which is convex in longitudinal section, for forming a displacement element and the guiding element is axially displaceable between two positions in such a way that the guiding element, in a first position, enables a flow between guiding element and outer wall and, in a second position, prevents a flow between guiding element and outer wall.

The method according to the invention for operating a gas turbine having an exhaust gas diffuser provides that in the case of an increase of the mass flow flowing through the gas turbine the guiding element is displaced in the direction of the second position, or into the second position, and/or in the case of a decrease of the mass flow the guiding element is displaced in the direction of the first position, or into the first position.

The invention is based on the knowledge that in the case of small mass flows, as occur on hot days and during partial-load operation in the gas turbine, the greater proportion of the mass flow in the exhaust gas diffuser of the gas turbine is displaced towards the outside, that is to say towards the outer wall, so that a very pronounced and long backflow zone aft of the hub occurs. In the case of large mass flows, as occur on cold days or during full-load operation, for example, the greater proportion of the mass flow is displaced more towards the inside, that is to say towards the hub or towards the center. As a result, the proportion of the flow which is near to the outer wall is reduced, which can lead to flow separation on the outer wall. Therefore, it is altogether desirable to homogenize the mass flow distribution inside the exhaust gas diffuser.

For the homogenization, however, depending upon the operating state of the gas turbine, the mass flow must be displaced either more towards the outer wall or towards the center of the exhaust gas diffuser. In order to achieve this, the invention combines two measures in an unforeseeable manner. For displacing the mass flow towards the outside, the guiding element is of an axially displaceable design, as a result of which the distance between guiding element and outer wall is adjustable. With increasing distance, a greater proportion of the flow can be deflected towards the outer wall, which reduces the probability of a near-wall flow separation. Moreover, the guiding element, on its inwardly oriented surface, has an encompassing contour, which is convex in longitudinal section, for forming a displacement element. As a result, the inner contour of the annular guiding element has the form of a Laval nozzle. This leads to the diffuser flow which is captured by the guiding element being deflected more towards the hub or towards the diffuser center. This is all the more applicable the greater the relative area proportion of the circular opening of the guiding element is with regard to the position-dependent flow-passable cross sectional area of the exhaust gas diffuser itself. With the guiding element located in the second position, that is to say with the guiding element butting against the outer wall, the cross sectional area of the exhaust gas diffuser corresponds to the cross-sectional area of the guiding element. The ratio is therefore equal to 1. By axial displacement of the guiding element in the downstream-ward direction of the exhaust gas flow, the flow-passable cross section of the exhaust gas diffuser—in that axial position at which the inlet cross-sectional area of the guiding element is also located—increases, whereas the inlet cross-sectional area of the guiding element remains the same. As a result, the relative proportion of the cross-sectional area is reduced, that is to say the ratio drops below 1, so that the effect of the constriction with increasing distance between guiding element and outer wall decreases, which is also desirable since in this case the proportion of the flow shall be displaced more towards the outer wall than towards the center of the exhaust gas diffuser.

The invention is therefore based on the unexpected knowledge that despite the use of an inwardly oriented constriction a strengthening of the near-wall flow is possible. Accordingly, with the solution according to the invention the efficiency of the exhaust gas diffuser can be improved regardless of the magnitude of the mass flow since aerodynamic losses, which are attributed to relatively large backflow zones or are based on near-wall flow separations, are largely avoided.

Advantageous embodiments are disclosed in the dependent claims.

According to a first advantageous embodiment, if the guiding element is located in the second position, the displacement element is located in that axial section of the exhaust gas diffuser in which a hub body, which is arranged in the center of the exhaust gas diffuser, axially terminates. On account of the end of the hub body being arranged in the center, backflow zones are created in its turbulent regions and can be shortened with the aid of the constriction which is arranged on the guiding element. To this end, it is necessary, however, that the constriction is located axially directly downstream of the end of the hub body. An excessively large axial distance between the end of the hub body and the axial position of the constriction must be avoided so that the constriction also achieves the aerodynamically desired effect, specifically the displacement of a flow proportion towards the center, i.e. towards the flow center of the exhaust gas diffuser.

A radially outwardly oriented surface of the guiding element can preferably butt flat against a section of the outer wall. As a result of the flat abutment of the guiding element against the outer wall, a minimum near-wall leakage flow is effectively avoided since the guiding element butts particularly tightly against the outer wall. Wall flows which in their magnitude are excessively small and consequently ineffective are therefore effectively avoided.

According to a further advantageous embodiment, the guiding element is supported via ribs which are distributed along the circumference of the outer wall. This arrangement enables a simple construction for supporting the guiding element. According to a first variant of the aforesaid embodiment, the ribs are rigidly fastened to the outer wall, wherein provision is made on the inner end of each rib for a drive for the axial displacement of the guiding element. For this, provision is expediently made for double-acting hydraulic pistons by means of which the guiding element can be axially displaced in relation to the ribs and therefore also in relation to the outer wall. This first variant has the advantage that both ribs and guiding element can be rigidly designed in their dimensions. In other words, neither the diameter of the guiding element nor the length of the ribs have to be variable in order to be able to ensure the displaceability of the guiding element.

According to a second variant, the ribs are connected in an articulated manner in each case to the outer wall and to the guiding element, wherein the rotational axes of the joints extend in the tangential direction of the exhaust gas diffuser. This embodiment offers the advantage that the drive for the axial displacement of the guiding element from the flow passage of the exhaust gas diffuser is shifted into a somewhat colder region of the gas turbine, which lowers the demands on the drive with regard to temperature resistance. Since, however, the use of a guiding element which is constant in diameter is preferred, the ribs must be variable in their radial extent for this case. For expedience, the ribs are then telescopically movable in order to adjust their length during displacement of the guiding element. By preference, a stationary gas turbine is equipped with an exhaust gas diffuser of the aforesaid embodiments.

BRIEF DESCRIPTION OF THE DRAWINGS

The invention is explained in more detail based on an exemplary embodiment. Schematically, in the drawing.

DETAILED DESCRIPTION OF THE INVENTION

Figure 1:
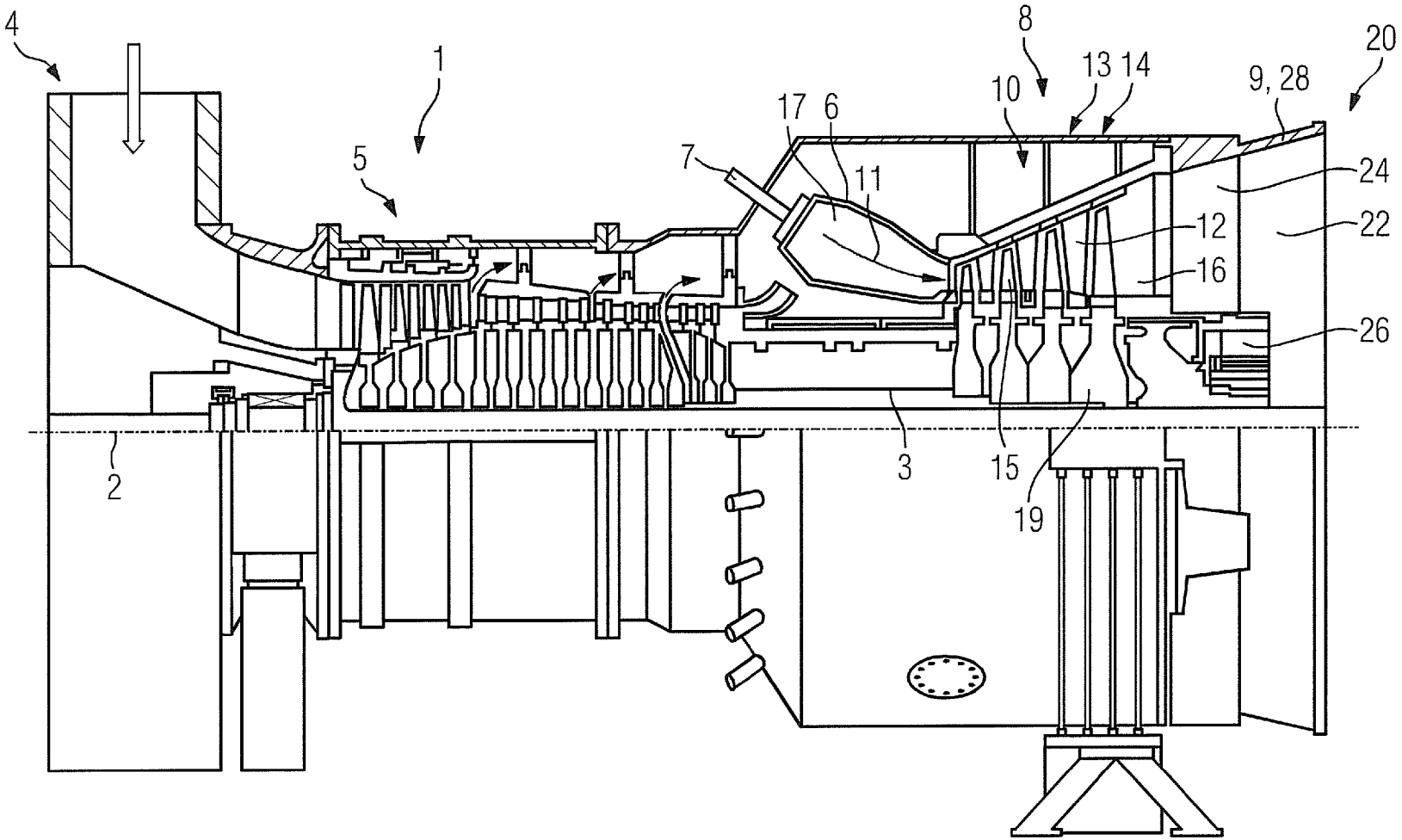
FIG. 1 shows a stationary gas turbine in a longitudinal partial section.

FIG. 1 shows a gas turbine 1 in a longitudinal partial section. Inside, it has a rotor 3—also referred to as a turbine rotor assembly—which is rotatably mounted around a machine axis 2. An intake housing 4, a compressor 5, a toroidal annular combustion chamber 6 with a plurality of burners 7 arranged rotationally symmetrically to each other, a turbine unit 8 and an exhaust housing 9 are arranged in series along the rotor 3. The annular combustion chamber 6 encloses a combustion space 17 which is connected to an annular hot gas passage 16. Four series-connected blade stages 10 form the turbine unit 8 there. Each blade stage 10 is formed from two blade rings. A row 14 formed from rotor blades 15 follows in each case a stator blade row 13 in the hot gas passage 16, as seen in the flow direction of a hot gas 11 which is produced in the annular combustion chamber 6. The stator blades 12 are fastened on the stator, whereas the rotor blades 15 of a row 14 are attached in each case on the rotor 3 by means of a disk 19. A generator or a driven machine (not shown) is coupled to the rotor 3.

Downstream of the turbine unit 8, the exhaust gas housing 9 adjoins the hot gas passage 16. The exhaust gas housing 9 is the inlet-side part of an exhaust gas diffuser 20 of the gas turbine 1. Therefore, the hot gas passage 16 merges into the flow passage 22 of the exhaust gas diffuser 20. The ribs 24 which are arranged in the exhaust gas housing 9 support the turbine-side end of the rotor 3, wherein this is encapsulated by a hub body 26. The hub body 26 axially terminates in the flow passage 22 and is arranged in the center of the exhaust gas diffuser 20.

The outer limit of the exhaust gas diffuser 20 is formed by an outer wall 28 which is of circular design and located concentrically to the machine axis 2. The outer wall 28 extends in a diverging manner in the flow direction of the diffuser flow 30 which is referred to as hot gas 11 before expansion in the turbine unit 8.

Figure 2:
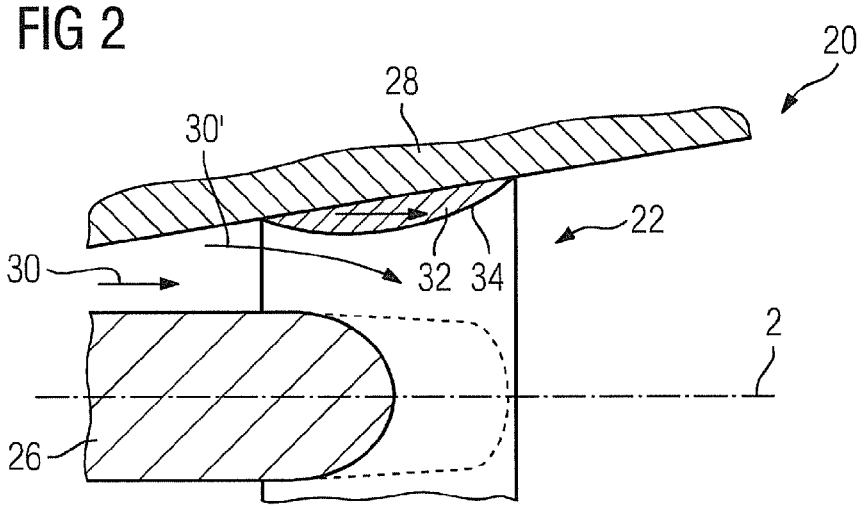
FIG. 2 shows the exhaust gas diffuser of a stationary gas turbine in longitudinal section, with a guiding element butting against the outer wall of the exhaust gas diffuser.

FIG. 2 shows a longitudinal section through the inlet-side section of the exhaust gas diffuser 20. In the axial section in which the hub body 26 axially terminates, an axially displaceable guiding element 32 is arranged. The outwardly oriented surface of the guiding element 32 in this case has the same conicity as the outer wall 28 so that the guiding element 32 butts flat against the outer wall 28. The inwardly oriented surface 34 of the guiding element 32 has an encompassing contour, which is concave in longitudinal section, for forming a displacement element. The contour is designed in this case so that the flow cross section which is encompassed by the annular guiding element 32 is designed in the style of a Laval nozzle. In other words, an inlet-side flow cross section of the guiding element 32 is larger than a minimum flow cross section of the guiding element 32, wherein the outlet-side flow cross section is larger than the inlet-side flow cross section. The minimum flow cross section is located axially between the inlet-side cross section and the outlet-side cross section. The respective flow cross section always lies perpendicularly to the machine axis 2.

Figure 3:
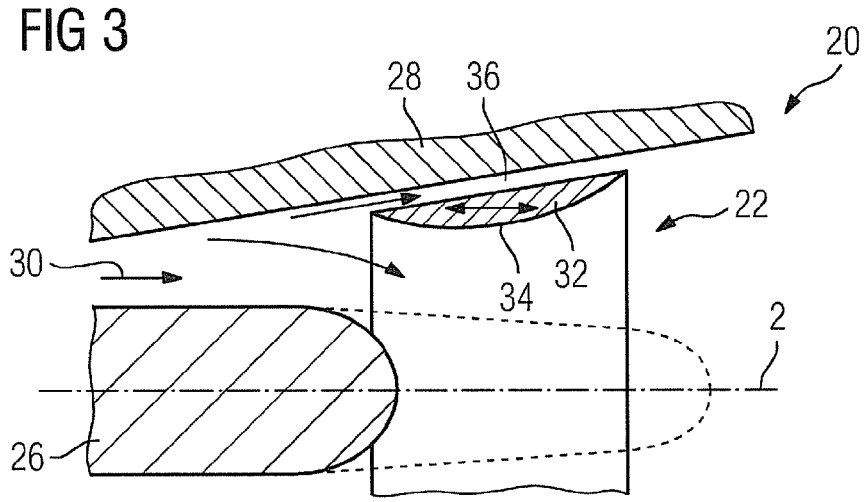
FIG. 3 shows the exhaust gas diffuser according to FIG. 2, with a guiding element at a distance from the outer wall.

Shown in FIG. 3 is the identical section of the exhaust gas diffuser 20 as shown in FIG. 2, only the guiding element 32 is displaced in the axial direction compared with the position shown in FIG. 2. The guiding element 32 according to FIG. 3 is now located downstream of the position shown in FIG. 2. The position of the guiding element 32 shown in FIG. 3 is referred to as the first position of the guiding element 32 and the position of the guiding element 32 shown in FIG. 2 is referred to as the second position.

As a result of the displacement of the guiding element 32 in the downstream-ward direction, an annular flow passage 36 is created between the inner surface of the outer wall 28 and the outwardly facing surface of the guiding element 32, through which flow passage a portion of the diffuser flow 30 can flow.

During operation of the gas turbine 1 which is equipped with an exhaust gas diffuser 20 of the depicted type, the following states can occur: With varying ambient conditions and during partial-load operation, rather smaller mass flows of hot gas 11 or exhaust gas 30 pass through the gas turbine 1. On account of the smaller mass flow, a greater proportion of the exhaust gas flow is displaced outwards so that previously a very pronounced and long backflow zone occurred aft of the hub body 26. According to the invention, it is now provided that the guiding element 32 is moved into the second position. As a result, the constriction is located comparatively close to the hub body 26. This has the effect of the exhaust gas 30 being sharply deflected (30') in the direction of the center axis 2, which significantly makes the backflow region in the axial section aft of the hub body 26 smaller. This reduces aerodynamic losses, increases the pressure recovery and homogenizes the velocity and flow profile in the exhaust gas diffuser 20.

During another, second state, which occurs on cold days and at full load, for example, a comparatively large mass flow passes through the gas turbine. In this case, the guiding element 32 is displaced in the axial direction into a first position. As a result of the displacement, the relative blocking of the flow cross section of the exhaust gas diffuser 20 decreases on account of the guiding element 32. Furthermore, the annular flow passage 36 between the outer wall 28 and the outer surface of the guiding element 32 is created in this way. The flow through this passage 36 leads—downstream of the guiding element 32—to a wall jet which reduces the risk of flow separation on the outer wall 28 which is increased for this operating state.

Also, this prevents aerodynamic losses in the exhaust gas diffuser 20, which leads to an increased pressure recovery. Consequently, it is provided that in the case of an increase of the mass flow the guiding element 32 is displaced in the direction of the second position, or into the second position (until butting against the outer wall 28) and/or in the case of a decrease of the mass flow the guiding element 32 is displaced in the direction of the first position, or into the first position (guiding element 32 at a distance from the outer wall 28). The displacement of the guiding element 32 is always carried out parallel to the machine axis 2.

Due to the fact that the guiding element 32 is only displaced in the axial direction, it is possible to design this as a ring with constant diameter.

Figure 4:
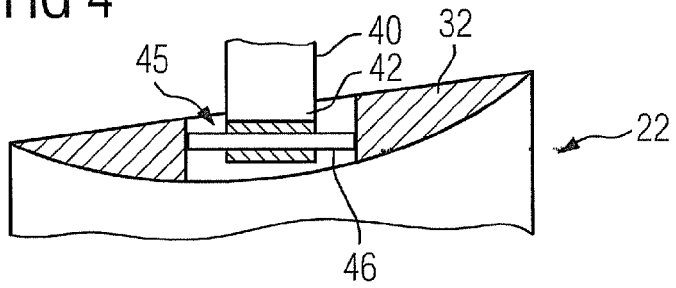
FIG. 4 shows the guiding element with a drive for axial displacement of the guiding element.

FIG. 4 shows a detail for the drive of the axially displaceable guiding element 32. The guiding element 32 is mounted via a plurality of ribs 40 which are distributed along the circumference of the exhaust gas diffuser 20. Each of the ribs 40 is rigidly fastened to the outer wall 28, but which is not shown in FIG. 4. The ribs 40 project radially into the flow duct 22. As an adjustment device, on an inner end 42 of the ribs 40 provision is made in each case for a hydraulic cylinder 45, the axially displaceable pistons 46 of which are fastened to the guiding element 32. By pressurizing with hydraulic oil, the piston 46 can be moved in the axial direction, which leads to the displacement of the guiding element 32 in the same direction. If necessary, cooling of the adjustment device and feed lines for hydraulic oil may be expedient on account of the comparatively high exhaust gas temperatures.

Disclosed by the invention is an exhaust gas diffuser 20 for a gas turbine 1, which has an annular outer wall 28 for guiding the diffuser flow 30, in which an annular guiding element 32, which is arranged concentrically to the outer wall 28, is provided for influencing the diffuser flow 30. In order to improve the aerodynamic effect of the exhaust gas diffuser 20 and to optimally adjust this at the same time for a plurality of operating states of the gas turbine, it is proposed that the guiding element 32 has a radially inwardly oriented surface 34 which has an encompassing contour, which is convex in longitudinal section, for forming a displacement element, and that the guiding element 32 is axially displaceable between two positions in such a way that the guiding element 32, in a first position, enables a flow between guiding element 32 and outer wall 28 and, in a second position, largely prevents a flow between guiding element 32 and outer wall 28. Also disclosed is a method for operating a gas turbine 1, in which for reducing aerodynamic losses and increasing pressure recovery in the case of an increase of the mass flow the guiding element 32 is displaced in the direction of the second position, or into the second position, and/or in the case of a decrease of the mass flow the guiding element 32 is displaced in the direction of the first position, or into the first position.

The invention claimed is:

1. An exhaust gas diffuser for a gas turbine, comprising:

an annular outer wall for guiding a diffuser flow; and an annular guiding element arranged concentrically to the outer wall for influencing the diffuser flow, wherein the guiding element is axially displaceable between a first position and a second position, wherein a radially inwardly oriented surface of the guiding element has an encompassing contour that is convex in longitudinal section for forming a displacement element, wherein the guiding element enables a flow between the guiding element and the outer wall in the first position and prevents the flow between the guiding element and the outer wall in the second position, and wherein the displacement element is located in an axial section of the exhaust gas diffuser in which a hub body arranged in a center of the exhaust gas diffuser axially terminates when the guiding element is located in the second position.

2. The exhaust gas diffuser as claimed in claim 1, wherein a radially outwardly oriented surface of the guiding element butts flat against a section of the outer wall.

3. The exhaust gas diffuser as claimed in claim 1, wherein the guiding element is supported via a plurality of ribs that are distributed along a circumference of the outer wall.

4. The exhaust gas diffuser as claimed in claim 1, wherein the plurality of ribs are rigidly fastened to the outer wall, and wherein a drive is arranged on an inner end of at least one of the plurality of ribs for axially displacing the guiding element.

5. The exhaust gas diffuser as claimed in claim 3, wherein the plurality of ribs are articulately connected to the outer wall and to the guiding element, and wherein rotational axis of a plurality of joints extend in a tangential direction of the exhaust gas diffuser.

6. A gas turbine, comprising:

an exhaust gas diffuser as claimed in claim 1.

7. A method for operating a gas turbine, comprising:

passing a mass flow through the gas turbine with a plurality of magnitude, wherein the gas turbine is claimed as in claim 6, wherein the guiding element is displaced in a direction of the second position for increasing the mass flow, and wherein the guiding element is displaced in a direction of the first position for decreasing the mass flow.

8. The method as claimed in claim 7, wherein the guiding element is displaced into the second position for increasing the mass flow and is displaced into the first position for decreasing the mass flow.

* * * * *